US006387032B1

(12) United States Patent
Beyer

(10) Patent No.: US 6,387,032 B1
(45) Date of Patent: May 14, 2002

(54) SCREW-TYPE SOLID BOWL CENTRIFUGE WITH MULTISTAGE PLANETARY GEAR TRAIN

(75) Inventor: Hans-Joachim Beyer, Ennigerloh (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 09/622,408

(22) PCT Filed: Jan. 7, 1999

(86) PCT No.: PCT/EP99/00055

§ 371 Date: Aug. 17, 2000

§ 102(e) Date: Aug. 17, 2000

(87) PCT Pub. No.: WO99/42220

PCT Pub. Date: Aug. 26, 1999

(30) Foreign Application Priority Data

Feb. 17, 1998 (DE) ..... 198 06 374

(51) Int. Cl.[7] ..... B04B 9/08
(52) U.S. Cl. ..... 494/53; 494/83; 494/84
(58) Field of Search ..... 494/7–9, 50–54, 494/83, 84; 475/331, 332, 346

(56) References Cited

U.S. PATENT DOCUMENTS

| | | | | |
|---|---|---|---|---|
| 1,572,612 | A | * | 2/1926 | Laughlin |
| 1,655,426 | A | * | 1/1928 | Laughlin |
| 1,710,315 | A | * | 4/1929 | Laughlin |
| 1,882,383 | A | * | 10/1932 | Hallitt |
| 1,962,461 | A | * | 6/1934 | Piper |
| 2,043,661 | A | * | 6/1936 | Howe |
| 2,458,706 | A | * | 1/1949 | Howe |
| 2,649,816 | A | * | 8/1953 | Kuster et al. |
| 2,867,378 | A | * | 1/1959 | Harlow |
| 3,061,181 | A | | 10/1962 | Gooch |
| 3,187,997 | A | * | 6/1965 | Gooch |
| 3,290,962 | A | * | 12/1966 | McCann et al. |
| 3,419,211 | A | * | 12/1968 | Yasuda et al. |
| 3,428,247 | A | * | 2/1969 | Andresen et al. |
| 3,599,861 | A | * | 8/1971 | DeMartini |
| 3,734,399 | A | * | 5/1973 | Oas |
| 3,923,241 | A | * | 12/1975 | Cyphelly |
| 4,129,249 | A | * | 12/1978 | Todd |
| 4,132,131 | A | * | 1/1979 | DeBruyne |
| 4,299,353 | A | * | 11/1981 | Bruning et al. |
| 4,327,862 | A | * | 5/1982 | Jakobs |
| 5,037,372 | A | | 8/1991 | Weder |

(List continued on next page.)

FOREIGN PATENT DOCUMENTS

| | | | |
|---|---|---|---|
| DE | 1031221 | * | 5/1958 |
| DE | 1087086 | * | 8/1960 |
| DE | 1532706 | * | 6/1971 |
| DE | 3142779 | | 5/1983 |
| DE | 202812 | * | 10/1983 |

(List continued on next page.)

*Primary Examiner*—Charles E. Cooley
(74) *Attorney, Agent, or Firm*—Barnes & Thornburg

(57) ABSTRACT

The invention relates to a screw-type centrifuge configured in such a way that the use of multistage planetary gear trains allows for high peripheral speeds of the drum and large drum diameters. According to the invention the drum bearing on the gear train side is positioned between two stages of the multistage planetary gear train. The housing jacket of the multistage planetary gear train, which is connected to the drum jacket and therefore rotates at the same r.p.m., has an intermediate piece which has a small diameter and is housed by the drum bearing together with a shaft connecting the gear train stages. The system provided for in the invention, according to which the drum bearing on the gear train side is positioned between two stages of the multistage planetary gear train, is used in the case of very large decanters for which the drum rotates at very high peripheral speeds.

5 Claims, 2 Drawing Sheets

U.S. PATENT DOCUMENTS

| | | | | |
|---|---|---|---|---|
| 5,403,260 | A | | 4/1995 | Hensley |
| 5,529,566 | A | * | 6/1996 | Weil |
| 5,558,769 | A | * | 9/1996 | Witthaus et al. |
| 5,772,573 | A | * | 6/1998 | Hao |
| 5,941,810 | A | * | 8/1999 | Gay |
| 6,056,685 | A | * | 5/2000 | Nelson |
| 6,155,964 | A | * | 12/2000 | Hensley |

FOREIGN PATENT DOCUMENTS

| | | | |
|---|---|---|---|
| DE | 3810472 | * | 8/1989 |
| DE | 4028441 | * | 3/1992 |
| DE | 9409109 | * | 9/1995 |
| EP | 271898 | | 12/1987 |
| EP | 0409791 | | 7/1990 |
| EP | 469944 | * | 2/1992 |
| FR | 2070485 | * | 9/1971 |
| FR | 2610058 | * | 7/1988 |
| GB | 776263 | * | 6/1957 |
| GB | 2016306 | * | 9/1979 |
| SU | 1168293 | * | 7/1985 |

* cited by examiner

SCREW-TYPE SOLID BOWL CENTRIFUGE WITH MULTISTAGE PLANETARY GEAR TRAIN

BACKGROUND AND SUMMARY OF THE INVENTION

The invention pertains to a screw-type solid-bowl centrifuge with a driven drum that is supported at both end surfaces and turns about a horizontal axis, and with a transport screw that is rotatably and coaxially arranged in the drum and can be driven at a different speed than the drum, where the drive contains a multistage planetary gear train, the housing jacket of which is connected to the drum jacket, and with the drive shaft of the multistage planetary gear train being connected to the transport screw.

The solid matter is transported to the solid matter discharge at one end surface of the drum due to the differential speed between the drum and the screw.

During the operation, the housing of the multistage planetary gear train rotates about the horizontal axis of rotation of the drum. Since the gear housing is connected to the drum jacket, both components rotate at the same speed.

There exist screw-type solid-bowl centrifuges in which the planetary gear train is arranged between the drum bearings or outside the drum bearing on the drive end together with the drum.

U.S. Pat. No. 3,061,181 discloses a screw-type centrifuge in which the planetary gear train is arranged between the drum bearings together with the drum. In this screw-type centrifuge with a so-called "internal gear train," the bearing on the drive end can be relatively small, but the distance between the two bearings is increased by the structural width of the planetary gear train.

U.S. Pat. No. 5,403,260 discloses a screw-type centrifuge in which the planetary gear train is arranged outside the drum bearing arrangement. This screw-type centrifuge contains a so-called "external gear train." Here, it is disadvantageous that the hub of the housing of the planetary gear train as well as the driven gear shaft must extend through the bearing of the drum on the driven end. At high rotational speeds of the drum and the transport screw, the resulting bearing size can lead to certain problems.

In large screw-type centrifuges, the natural frequency of the drum represents one factor limiting the maximum attainable drum speed. The natural frequency $\omega$ of the drum decreases with the distance L between the drum bearings such that the maximum attainable rotational speed of the drum is-reduced to $$\omega \sim 1/L^2$$

For reasons of process technology, a high ratio between the drum length and the drum diameter D, L/D, is usually desired.

Due to the aforementioned problems, the maximum structural length of the drum is reduced by the gear width in screw-type centrifuges with internal gear trains. The high torques occurring in large screw-type centrifuges may make it necessary to provide a multistage planetary gear train such that the width of the gear train is also increased. However, these high torques also result in such large diameters of the driven gear shaft that an external gear train cannot be used due to the disadvantageous bearing size associated with them.

The invention is based on the objective of designing a screw-type centrifuge of the initially mentioned type in such a way that the use of multistage planetary gear trains allows high circumferential speeds of the drum and large drum diameters.

According to the invention, this objective is attained in that the drum bearing on the gear train side is arranged between two stages of the multistage planetary gear train.

In one advantageous embodiment, the housing of the multistage planetary gear train contains a cylindrical intermediate piece within the region of the drum bearing on the gear train side, with the diameter of this intermediate piece being reduced in comparison to the housing parts of the gear train stages. The drum bearing on the gear train side accommodates the intermediate piece as well as a shaft that connects the gear train stages. Consequently, the diameter of the intermediate piece corresponds to the inside diameter of a suitable drum bearing.

In the embodiment according to the invention, at least the last gear train stage with the largest diameter is arranged between the drum bearings together with the drum such that the driven gear shaft with the largest diameter need not extend through the drum bearing on the gear train side and the structural width of the gear only partially affects the distance between the drum bearings. The additional gear train stages can be realized in the form of external gear train stages. The gear train housing must consist of two parts such that the bearing can be mounted within the region of the intermediate piece.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
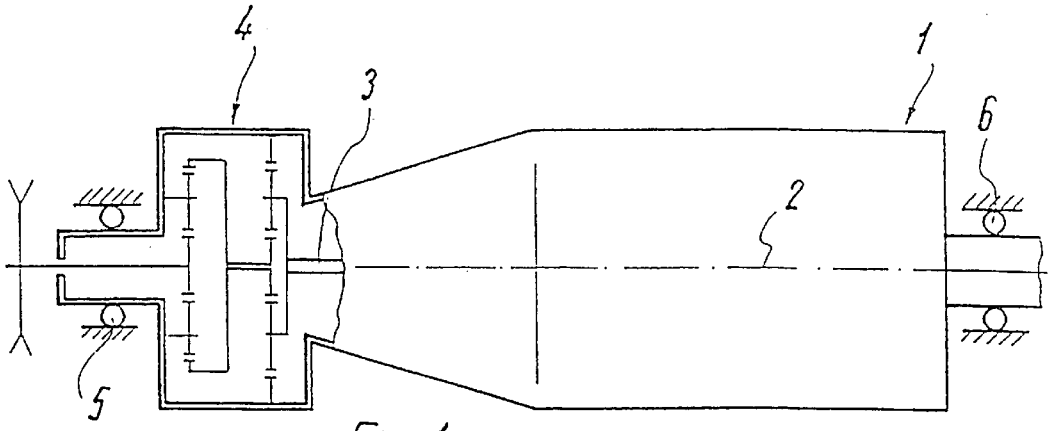
Fig. 1 (PRIOR ART)
FIG. 1 is a schematic representation of a known screw-type centrifuge with an interior multistage planetary gear train.

The screw-type solid-bowl centrifuges shown in FIGS. 1–6 contain a drum 1 that turns about a horizontal axis 2. A transport screw 20 (shown in phantom) is coaxially arranged in the drum and can also turn about the horizontal axis 2 coaxial with driving shaft 22. The drive of the transport screw 20 is realized with the driven shaft 3 of a multistage planetary gear train 4 or 9 arranged between the bearings 5, 6 together with the drum 1 in the screw-type solid-bowl centrifuge according to FIG. 1.

Figure 2:
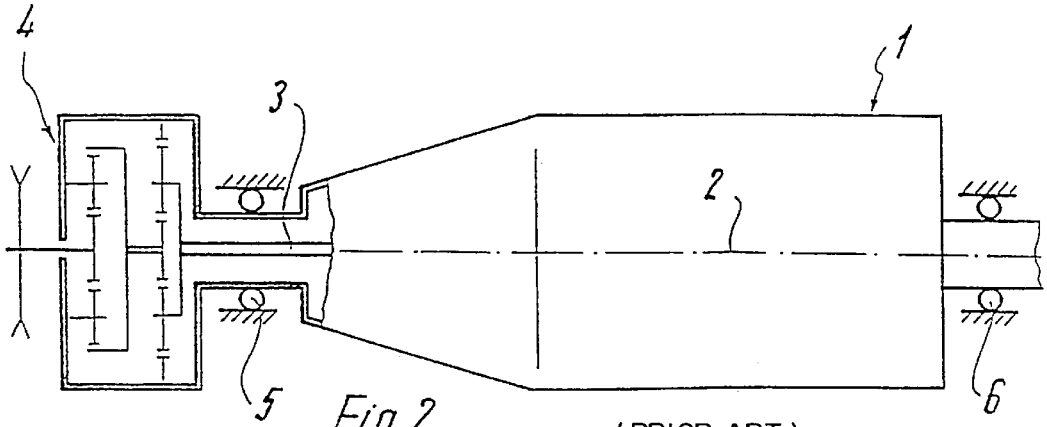
Fig. 2 (PRIOR ART)
FIG. 2 is a schematic representation of a known screw-type centrifuge with an external multistage planetary gear train.

In the embodiment according to FIG. 2, the planetary gear train 4 is arranged outside the bearing 5 on the gear train side.

Figure 3:
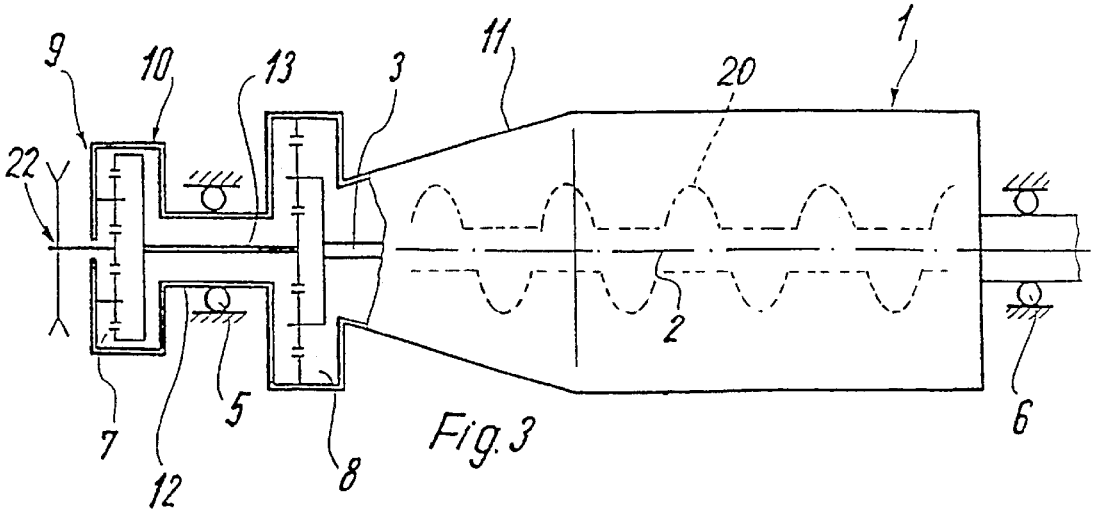
FIG. 3 is a schematic representation of an embodiment according to the invention.
Figure 4:
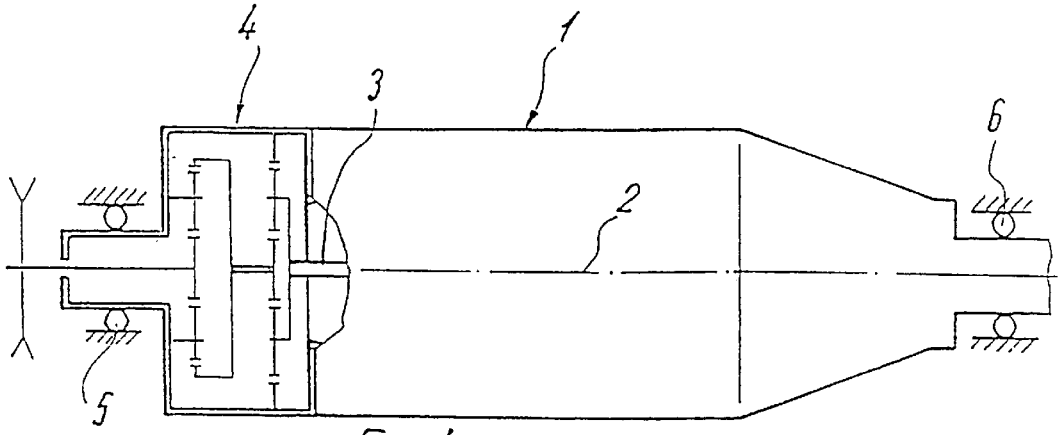
Fig. 4 (PRIOR ART)
FIG. 4 is a known screw-type centrifuge in which, in contrast to the embodiment according to FIG. 1, the planetary gear train is arranged on the end of the drum from which the liquid is discharged.
Figure 5:
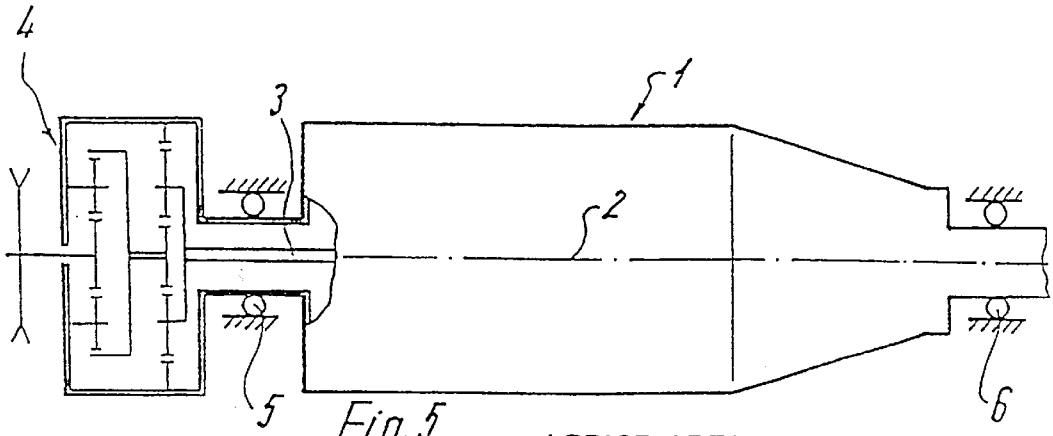
Fig. 5 (PRIOR ART)
FIG. 5 is a known screw-type centrifuge in which, in contrast to the embodiment according to FIG. 2, the planetary gear train is arranged on the end of the drum from which the liquid is released.
Figure 6:
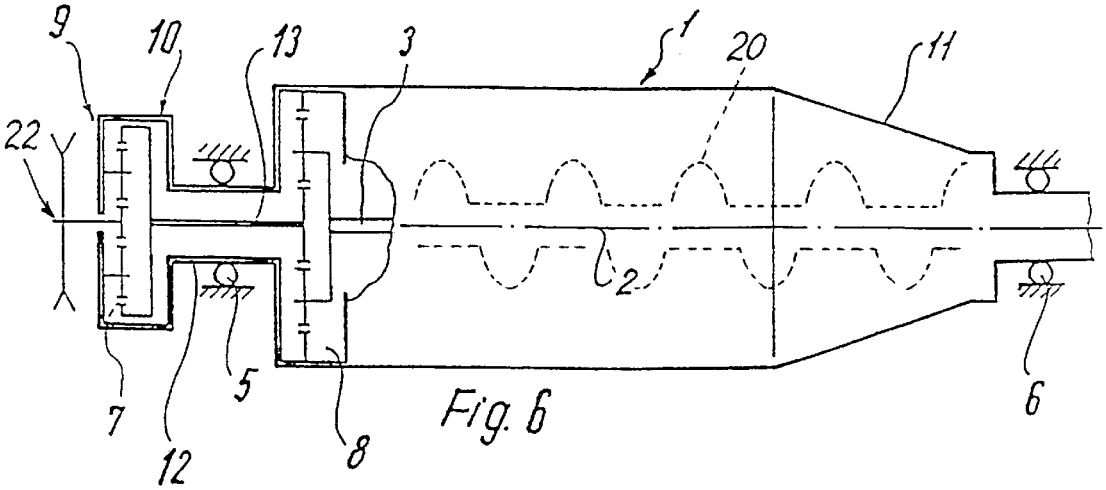
FIG. 6 is an embodiment according to the invention, in which the planetary gear train is arranged on the drum end on the liquid side.

Embodiments of the design according to the invention are shown in FIGS. 3 and 6. In these embodiments, the drum bearing 5 on the gear train side is arranged between the stages 7 and 8 of the planetary gear train 9. The gear train housing 10 which rotates during operation is connected to the drum jacket 11 and contains a cylindrical intermediate piece 12 of smaller diameter than the housing parts of the gear train stages 7 and 8 within the region of the drum bearing 5 on the gear train side. The bearing 5 consequently accommodates the intermediate piece 12 as well as a shaft 13, which connects the gear train stages 7 and 8.

The intermediate piece 12 is divided tranverse to the axis of rotation 2 for assembly reasons.

In the screw-type solid-bowl centrifuge according to the invention, the drum jacket 11 may have a diameter that is greater than 1000 mm. The ratio of the axial distance L of the bearings 5 and 6 of the drum 1 to the diameter D of the drum jacket 11, L/D, may be greater than 3.8. The torque between the drum and the transport screw may be 100,000 Nm, e.g. The circumferential speed of the inside radius of the tapered portion of the drum jacket 11 may be greater than 105 meters per second.

The arrangement of the drum bearing on the gear train side between two stages of a multistage planetary gear train in accordance with the invention is particularly suitable for very large decanters.

The illustration of the screw-type centrifuges according to the invention in FIGS. 3 and 6 indicates that the planetary gear train can be arranged on the drum end on the solid side or on the liquid side if the drum bearing 5 is arranged between the gear train stages.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A screw-type solid-bowl centrifuge, comprising:

a driven drum having two end surfaces and supported at both end surfaces and turning about a horizontal axis;

a transport screw rotatably and coaxially arranged in the drum that can be driven at a different speed than the drum;

a drive having a multistage planetary gear train positioned on a gear train side of the drum and having a driving shaft and a driven shaft, the gear train having a housing jacket connected to a drum jacket of the drum, and with the driven shaft of the multistage planetary gear train being connected to the transport screw; and wherein a drum bearing on the gear train side is arranged between two stages of the multistage planetary gear train, is external to the drum and lies between the housing jacket and a support for the drum.

2. A screw-type solid-bowl centrifuge according to claim 1, wherein the housing jacket of the multistage planetary gear train contains a cylindrical intermediate piece of smaller diameter than housing parts of the gear train stages within a region of the drum bearing on the gear train side, with the bearing accommodating the intermediate piece as well as a shaft that connects the gear train stages.

3. A screw-type solid-bowl centrifuge according to claim 2, wherein the intermediate piece is divided transverse to the axis of rotation.

4. A screw-type solid-bowl centrifuge according to claim 1, wherein the drum jacket has an inside diameter greater than 1,000 mm and, the ratio of the axial distance of bearings of the drum to the diameter of the drum jacket is greater than 2.8, and, torque between the drum and transport screw is high, and circumferential speed of the inside diameter of the drum jacket is greater than 105 meters per second.

5. The screw-type solid-bowl centrifuge of claim 1, wherein the torque between the drum and the transport screw is approximately 100,000 Newton-meters.

* * * * *